US009964063B2

(12) United States Patent
Sato et al.

(10) Patent No.: US 9,964,063 B2
(45) **Date of Patent: *May 8, 2018**

(54) FUEL INJECTION VALVE WITH CYLINDER INTERNAL PRESSURE SENSOR

(71) Applicant: KEIHIN CORPORATION, Tokyo (JP)

(72) Inventors: Gaku Sato, Utsunomiya (JP); Kenichi Yoshimura, Sakura (JP); Keisuke Machida, Sakura (JP); Koji Suzuki, Utsunomiya (JP)

(73) Assignee: KEIHIN CORPORATION, Tokyo (JP)

( * ) Notice: Subject to any disclaimer, the term of this patent is extended or adjusted under 35 U.S.C. 154(b) by 102 days.

This patent is subject to a terminal disclaimer.

(21) Appl. No.: 14/970,905

(22) Filed: Dec. 16, 2015

(65) Prior Publication Data

US 2016/0208729 A1 Jul. 21, 2016

(30) Foreign Application Priority Data

Jan. 20, 2015 (JP) ..... 2015-008433

(51) Int. Cl.
*F02M 37/04* (2006.01)
*F02D 41/28* (2006.01)
(Continued)

(52) U.S. Cl.
CPC ..... *F02D 41/28* (2013.01); *F02M 51/005* (2013.01); *F02M 57/005* (2013.01);
(Continued)

(58) Field of Classification Search
CPC .... F02D 41/2096; F02D 41/20; F02M 51/061
(Continued)

(56) References Cited

U.S. PATENT DOCUMENTS 6,570,304 B1 * 5/2003 Okazaki ..... G01L 23/22 313/118
2005/0211214 A1 9/2005 Tomita
(Continued)

FOREIGN PATENT DOCUMENTS

JP 09-053483 2/1997

OTHER PUBLICATIONS

U.S. Office Action dated Apr. 14, 2017 in U.S. Appl. No. 14/997,703, filed Jan. 18, 2016, 15 pages.
(Continued)

*Primary Examiner* — John Kwon
(74) *Attorney, Agent, or Firm* — Rankin, Hill & Clark LLP

(57) ABSTRACT

Within a resin mold portion of a fuel injection valve, an amplifying member having a substrate is provided. An engagement hole that penetrates in an axial direction is formed in another end part of the amplifying member, and an engagement pin, which is formed on a bobbin of a housing, is inserted through the engagement hole. A second connector of a second signal transmitting member, which constitutes part of a signal transmitting unit, is inserted from below into a connecting hole formed in the substrate. In addition, when the resin mold portion is molded, the amplifying member is retained in a state with the engagement pin and the second connector being inserted, respectively, into the engagement hole and the connecting hole.

3 Claims, 4 Drawing Sheets

(51) Int. Cl.
*F02M 51/00* (2006.01)
*F02M 57/00* (2006.01)
*F02D 35/02* (2006.01)

(52) U.S. Cl.
CPC ..... *F02D 35/023* (2013.01); *F02D 2041/281* (2013.01); *F02D 2041/285* (2013.01); *F02D 2400/18* (2013.01); *F02M 2200/247* (2013.01)

(58) Field of Classification Search
USPC ..... 123/478, 490, 494, 498, 468
See application file for complete search history.

(56) References Cited

U.S. PATENT DOCUMENTS

2010/0050991 A1* 3/2010 Cooke ..... F02M 51/005 123/470
2011/0224885 A1 9/2011 Ohata
2014/0048041 A1 2/2014 Akazaki
2014/0316646 A1* 10/2014 Kaneko ..... F02M 57/005 701/34.4
2015/0059699 A1 3/2015 Sato
2015/0152824 A1 6/2015 Akazaki et al.
2016/0208753 A1* 7/2016 Sato ..... F02M 57/005
2016/0208754 A1* 7/2016 Sato ..... F02M 57/005
2016/0208755 A1* 7/2016 Sato ..... F02M 57/005
2016/0222892 A1 8/2016 Akazaki et al.

OTHER PUBLICATIONS

This application is co-pending with U.S. Appl. No. 14/970,900, filed Dec. 16, 2015, U.S. Appl. No. 14/970,893, filed Dec. 16, 2015, and U.S. Appl. No. 14/997,703, filed Jan. 18, 2016.
U.S. Office Action dated Sep. 26, 2017 from copending U.S. Appl. No. 14/997,703, 11 pages.
U.S. Office Action from co-pending U.S. Appl. No. 14/970,893, dated Feb. 22, 2018, 35 pages.

* cited by examiner

FUEL INJECTION VALVE WITH CYLINDER INTERNAL PRESSURE SENSOR

CROSS-REFERENCE TO RELATED APPLICATION

This application is based upon and claims the benefit of priority from Japanese Patent Application No. 2015-008433 filed on Jan. 20, 2015, the contents of which are incorporated herein by reference.

BACKGROUND OF THE INVENTION

Field of the Invention

The present invention relates to a fuel injection valve equipped with a cylinder internal pressure sensor, the sensor being capable of detecting a cylinder internal pressure in the interior of a combustion chamber, the fuel injection valve being used in a direct injection type internal combustion engine in which fuel is injected directly into the combustion chamber in the internal combustion engine.

Description of the Related Art

Heretofore, for example, as disclosed in Japanese Laid-Open Patent Publication No. 09-053483, with the aim of detecting a cylinder internal pressure of a combustion chamber in an internal combustion engine, it has been known to attach an internal pressure sensor to an end of a fuel injection valve. The internal pressure sensor is arranged between the end of the fuel injection valve and an attachment hole of a cylinder head that makes up the internal combustion engine. A lead line for transmitting to the exterior the detected cylinder internal pressure as an output signal is connected to the internal pressure sensor. In addition, the lead line is connected, for example, to an electronic control unit, whereby a control or the like is performed based on the cylinder internal pressure by outputting the cylinder internal pressure as an output signal to the electronic control unit.

SUMMARY OF THE INVENTION

However, with the above-described internal pressure sensor that is mounted on the fuel injection valve, the lead line, which is connected to the internal pressure sensor and the electronic control unit, is exposed to the exterior of the fuel injection valve. Therefore, in an assembled condition, or when the internal pressure sensor is attached to the cylinder head together with the fuel injection valve, there is a concern that a disconnection may occur as a result of loads that are applied with respect to the lead line, and that detection of the cylinder internal pressure cannot be performed due to such a disconnection.

Further, since the internal pressure sensor is arranged in contact with the cylinder head, for example, noise is easily generated due to vibrations, etc., of the internal combustion engine, and thus it is difficult for the detection value detected by the internal pressure sensor to be read out with high precision.

A general object of the present invention is to provide a fuel injection valve equipped with a cylinder internal pressure sensor, which can increase detection accuracy through the provision of an amplifying unit, and which can prevent a disconnection or the like by easily and reliably carrying out the assembly of a coil assembly and a signal transmitting member including the amplifying unit.

The present invention is characterized by a fuel injection valve equipped with a cylinder internal pressure sensor, the fuel injection valve being configured to directly inject fuel into a combustion chamber of an internal combustion engine, the sensor being provided at an end of the fuel injection valve, the sensor being configured to detect a cylinder internal pressure in an interior of the combustion chamber, the fuel injection valve including a housing, a signal transmitting member disposed in the interior of the housing and configured to transmit a detection signal based on the cylinder internal pressure, and a drive unit configured to drive a valve element by energizing a coil assembly including a coil. The signal transmitting member includes an amplifying unit configured to amplify and output the detection signal, the amplifying unit being constituted as a circuit body in which a substrate is molded by a resin material, power source terminals being connected to the substrate, the power source terminals being configured to supply electrical power to the sensor, and the fuel injection valve further includes an assembly unit configured to assemble the circuit body and the coil assembly.

According to the present invention, in a fuel injection valve equipped with a cylinder internal pressure sensor that detects a cylinder internal pressure in the interior of a combustion chamber, the signal transmitting member includes the amplifying unit that amplifies the detection signal. The amplifying unit includes the circuit body in which a substrate, to which power source terminals are connected, is molded by a resin material, and the injection valve further includes the assembly unit for assembling the circuit body and the coil assembly including the coil.

Consequently, since the circuit body of the amplifying unit and the coil assembly can be positioned at predetermined positions and easily and reliably connected by the assembly unit, it is possible to enhance ease of assembly while at the same time reliably avoiding the occurrence of a disconnection. Further, even in the event that noise is generated due to vibrations or the like of the internal combustion engine, the detection signal in which noise is comparatively small and which is near to the sensor can be amplified by the amplifying unit, and thus it is possible to increase the detection accuracy of the cylinder internal pressure by the sensor.

The above and other objects, features and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

Figure 1:
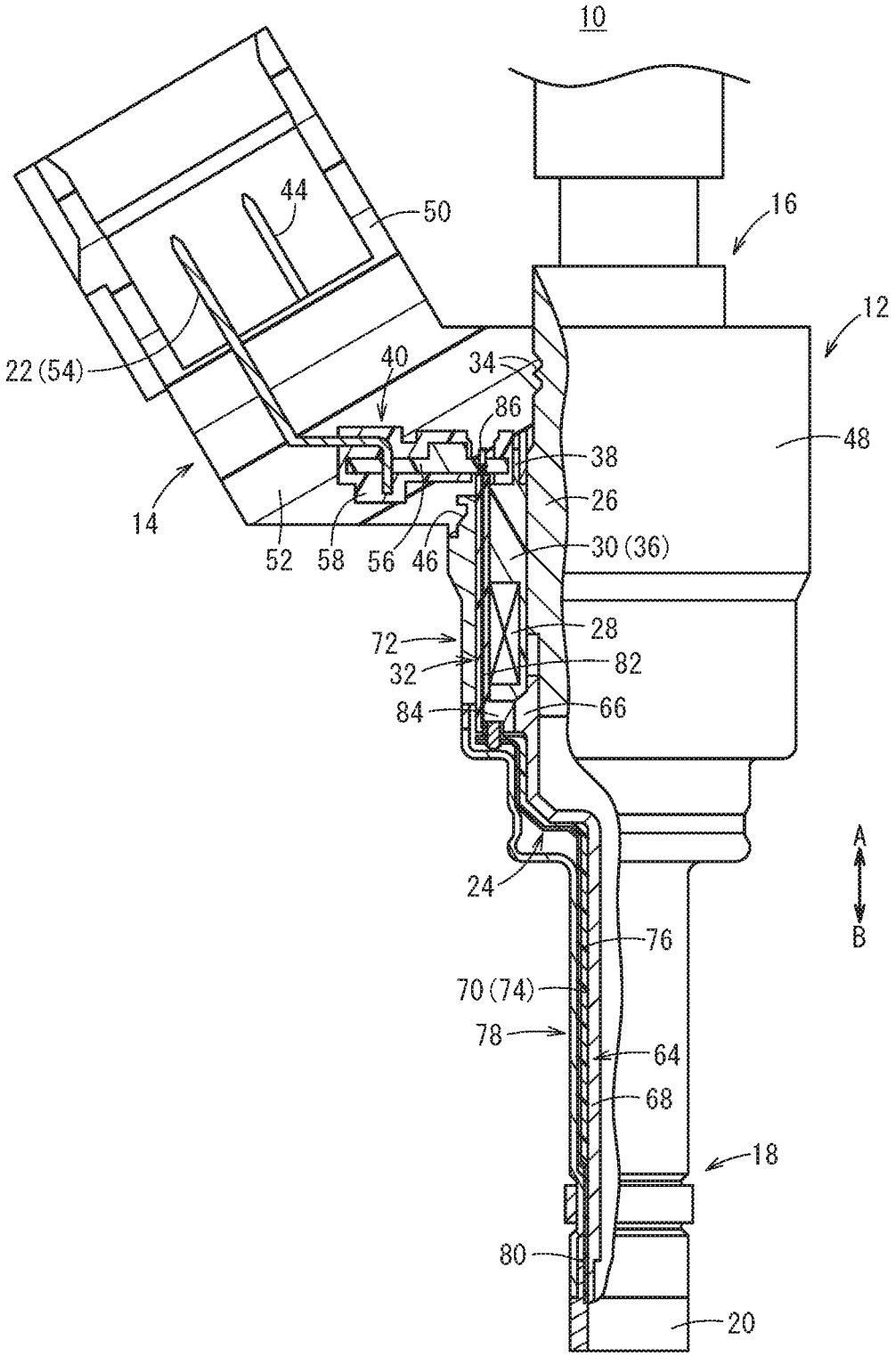
FIG. 1 is an overall front view, partially shown in cross section, of a fuel injection valve equipped with a cylinder internal pressure sensor according to an embodiment of the present invention.

As shown in FIG. 1, a fuel injection valve 10 equipped with a cylinder internal pressure sensor (hereinafter referred to simply as a fuel injection valve 10) includes a housing 12, a resin mold portion 14 provided on an outer circumferential side of the housing 12, a fuel supply unit 16 disposed on a proximal end of the housing 12 and to which fuel is supplied, a fuel injector 18 disposed on a distal end of the fuel supply unit 16, a sensor 20 mounted on a distal end of the fuel injector 18, and a signal transmitting unit (signal transmitting member) 24 that electrically interconnects the sensor 20 and a signal terminal (second signal transmitting unit) 22 connected to a non-illustrated electronic control unit (ECU) and thereby transmits output signals therebetween.

Below, the side of the fuel supply unit 16 in the fuel injection valve 10 will be referred to as a proximal end side (in the direction of the arrow A), and the side of the fuel injector 18 will be referred to as a distal end side (in the direction of the arrow B).

The housing 12, for example, is constituted as a solenoid unit that drives the fuel injection valve 10. The housing 12 includes a fixed core 26 that is disposed in the center thereof, a bobbin 30 that is provided on an outer circumferential side of the fixed core 26 and retains a coil 28, a cylindrical holder 32 disposed further on a distal end outer circumferential side of the bobbin 30, and a non-illustrated movable core (drive unit) that is displaced under a magnetically excited action of the coil 28.

The fixed core 26 extends further to the proximal end side (in the direction of the arrow A) of the housing 12 with respect to the proximal end of the holder 32, and is arranged in the center of the later-described resin mold portion 14. Annular first grooves 34, which are engaged with the later-described resin mold portion 14, are formed on the outer circumferential surface of the fixed core 26, Further, the fuel supply unit 16 is disposed on the proximal end side of the fixed core 26.

The bobbin 30 is formed in a cylindrical shape, for example, and is disposed between the fixed core 26 and the holder 32. On a proximal end side (in the direction of the arrow A) of the bobbin 30, a wall 36 is disposed at a position on the side of a coupler 50 of the housing 12 in the circumferential direction of the bobbin 30. The wall 36 is formed with an arcuate shape in cross section along the circumferential direction of the bobbin 30. The wall 36 projects out at a predetermined height toward the proximal end side (in the direction of the arrow A) in the axial direction, and an engagement pin (projection) 38 is formed on one end thereof (see FIG. 2).

Figure 4A:
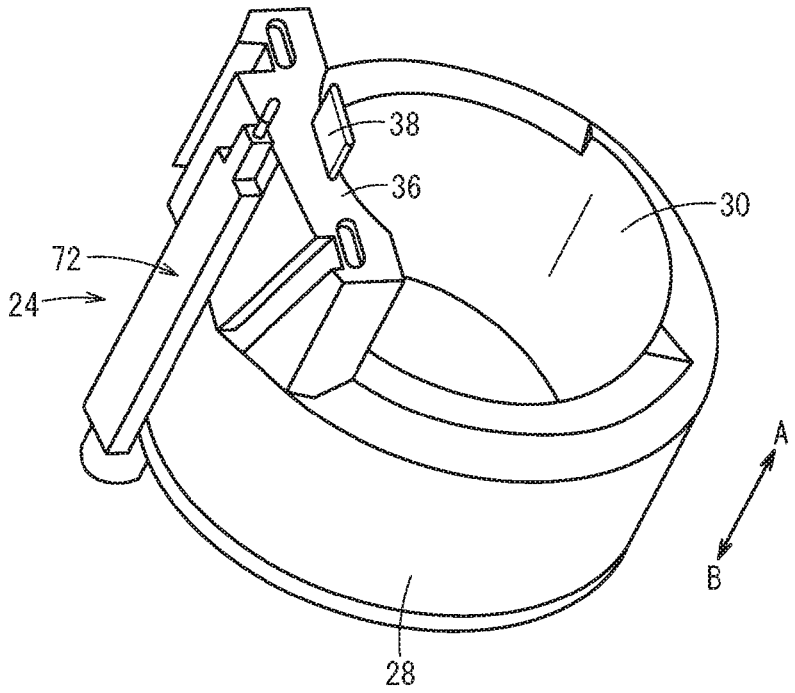
FIG. 4A is an exterior perspective view of a bobbin and a coil that constitute part of the fuel injection valve equipped with the cylinder internal pressure sensor of FIG. 1.
Figure 4B:
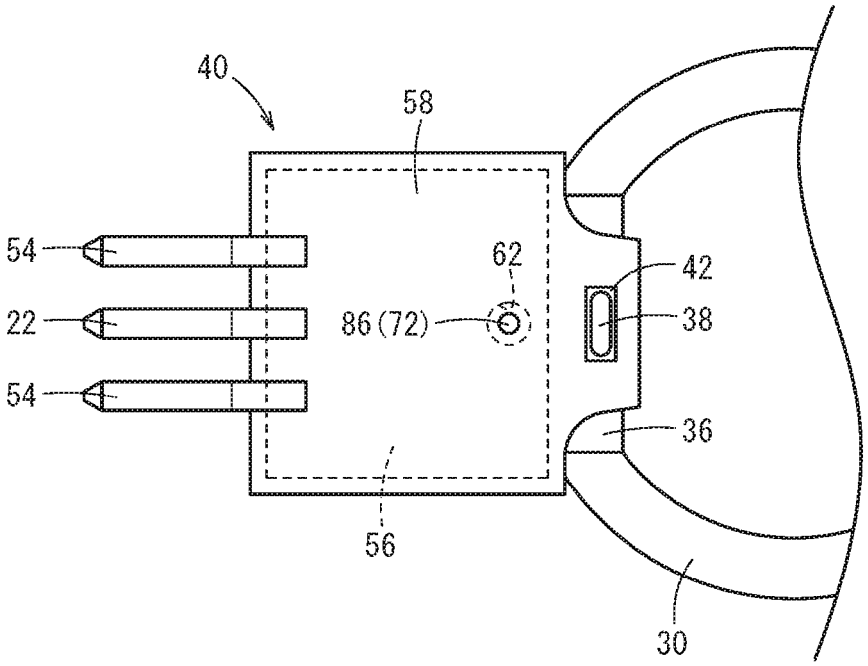
FIG. 4B is an enlarged plan view showing a condition in which the amplifying member is assembled on a proximal end of the bobbin.

As shown in FIGS. 4A and 4B, the engagement pin 38 is formed with a rectangular shape in cross section corresponding to an engagement hole 42 of an amplifying member 40, and is formed to project at a predetermined height in the axial direction from the proximal end part of the bobbin 30. In addition, the engagement pin 38 is formed at a position in the vicinity of the inner circumferential surface of the bobbin 30, and is inserted into the engagement hole 42 of the amplifying member 40.

Further, on an outer circumferential side of the bobbin 30, the coil 28 is wound in a radially inward recessed cavity, and a second signal transmitting member 72, which constitutes part of a later-described signal transmitting unit 24, is disposed on the outer circumferential side of the coil 28. Ends of the coil 28 extend to the proximal end side (in the direction of the arrow A) of the bobbin 30, and are connected respectively to a substrate 56 of the amplifying member 40. More specifically, the bobbin 30 on which the coil 28 is installed constitutes a coil assembly.

Ends of the coil 28 extend to the proximal end side (in the direction of the arrow A) of the bobbin 30, and are connected respectively to ends of a pair of drive terminals 44 incorporated in the later-described resin mold portion 14. In addition, by the coil 28 being supplied with electric current from non-illustrated connectors through the drive terminals 44, the coil 28 is excited and a magnetic force is generated. Owing to this feature, under a magnetic excitation action of the coil 28 in the housing 12, the non-illustrated movable core is displaced inside the bobbin 30, a valve element (not shown) disposed in the fuel injector 18 is attracted, and a valve open condition is brought about.

Further, on a proximal end outer circumferential surface of the holder 32, an annular second groove 46, which is recessed radially inward, is formed, and the later-described resin mold portion 14 is engaged therewith.

In addition, by connecting a non-illustrated connector to the coupler 50, power source terminals 54 and the signal terminal 22 are connected with the electronic control unit (not shown), and under an excitation action of the coil 28, the movable core is displaced in the interior of the bobbin 30, whereupon the valve element (not shown) disposed in the fuel injector 18 is pulled inward and the valve is then opened.

The resin mold portion 14, for example, is formed on the outer circumferential side of the housing 12 by being molded from a resin material. The resin mold portion 14 includes a main body section 48, which is formed in a cylindrical shape, the coupler 50 that projects out sideways from the proximal end of the main body section 48, and a connector 52 that interconnects the main body section 48 and the coupler 50.

Figure 2:
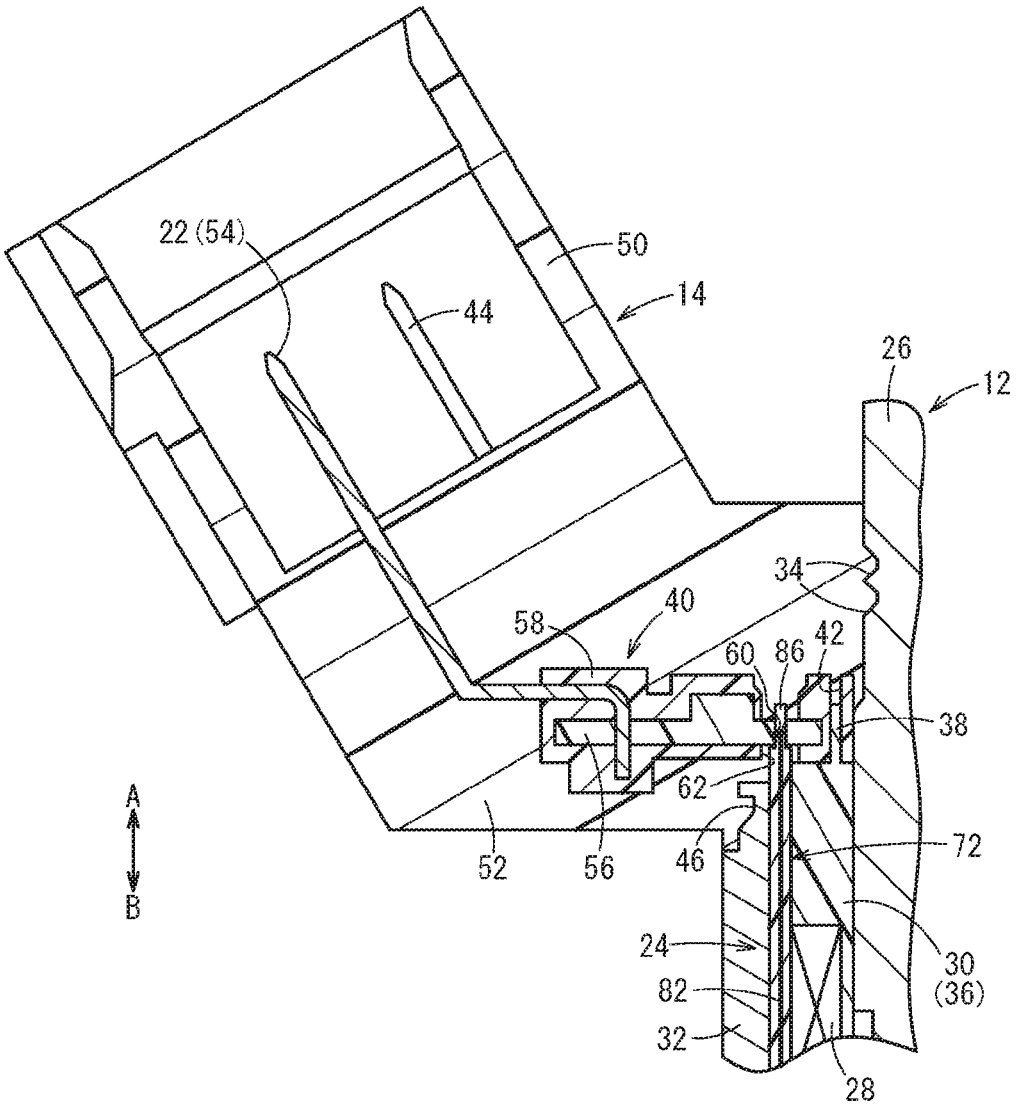
FIG. 2 is an enlarged cross-sectional view showing the vicinity of a coupler in the fuel injection valve equipped with the cylinder internal pressure sensor of FIG. 1.

In addition, by the resin mold portion 14 being molded by the resin material, the molten resin material enters respectively into the first grooves 34 of the fixed core 26 disposed in the center of the main body section 48, and the second groove 46 of the holder 32 disposed on the distal end side of the main body section 48, whereupon the housing 12 becomes fixed with respect to the center and the distal end of the resin mold portion 14 under an engagement action with the first and second grooves 34, 46 (see FIG. 2).

As shown in FIGS. 1 and 2, the coupler 50 is formed, for example, with a rectangular shape in cross section, and projects in an obliquely upward direction, so as to be inclined at a predetermined angle with respect to the axial direction (the direction of arrows A and B) of the main body section 48. Further, an end of the coupler 50 is opened and includes a space in the interior thereof, with power source terminals 54 and a signal terminal 22 of the amplifying member (amplifying unit) 40, and the pair of drive terminals 44 for energizing the coil 28 being provided in an outwardly exposed manner therein, respectively.

As shown in FIGS. 1 through 4B, the amplifying member 40, for example, is disposed in the interior of the resin mold portion 14. The amplifying member 40 includes a substrate 56 with a rectangular cross section, the power source terminals 54 and the signal terminal 22 that are connected electrically to the substrate 56, and a sealing member 58, which is formed so as to cover the entirety of the substrate 56. The amplifying member 40 is provided with the aim of amplifying a detection signal detected by the sensor 20, and outputting the amplified detection signal from the signal terminal 22 to external.

On the substrate 56, distal ends of the power source terminals 54 and the signal terminal 22 are connected to one end thereof, with the signal terminal 22 being arranged substantially in the center in the widthwise direction of the substrate 56, and the pair of power source terminals 54 being arranged on both sides of the signal terminal 22. In addition, the power source terminals 54 and the signal terminal 22 extend at a predetermined angle of inclination with respect to the substrate 56.

Figure 3:
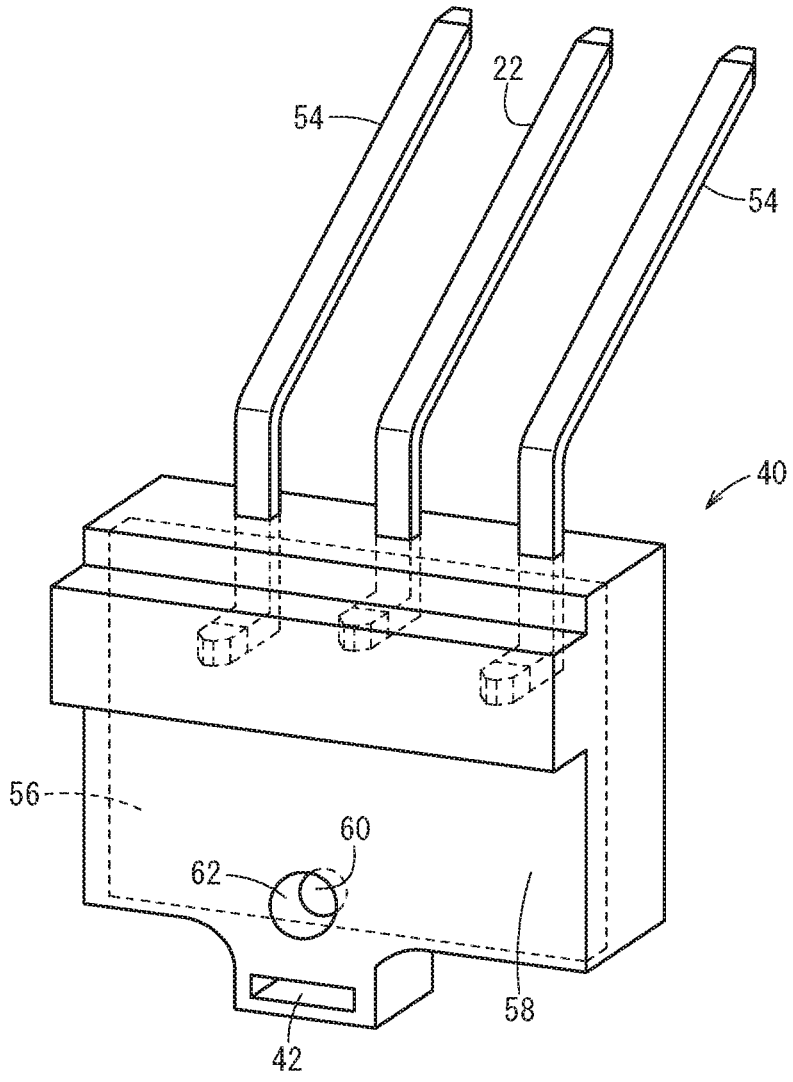
FIG. 3 is an exterior perspective view of an amplifying member that is incorporated in the fuel injection valve equipped with the cylinder internal pressure sensor of FIG. 1.

Further, on the other end side of the substrate 56, a connecting hole 60 is formed which is connected with the second signal transmitting member 72 of the later-described signal transmitting unit 24 (see FIGS. 2 and 3).

The sealing member 58 is formed, for example, from a resin material. In a state in which the ends of the power source terminals 54 and the signal terminal 22 are connected with respect to the one end of the substrate 56, the sealing member 58 is formed so as to cover the entirety of the substrate 56 at a predetermined thickness, as well as to cover the ends of the power source terminals 54 and the signal terminal 22 that are connected to the substrate 56. Consequently, the connection of the power source terminals 54 and the signal terminal 22 with respect to the substrate 56 is strongly maintained by the sealing member 58.

Further, on the other end side of the sealing member 58, a through hole 62 is formed that opens on the distal end side of the fuel injection valve 10 facing toward the connecting hole 60 of the substrate 56, the through hole 62 being formed to enable the second signal transmitting member 72 connected to the connecting hole 60 to be inserted therethrough. Together therewith, an engagement hole (recess) 42, which penetrates in the thickness direction of the sealing member 58, is formed at a position further toward the other end side than the through hole 62. The engagement hole 42, for example, is formed with a rectangular shape in cross section which is elongated in the widthwise direction of the substrate 56 and the sealing member 58. The engagement pin 38 of the bobbin 30 can be inserted into the engagement hole 42.

In addition, when the resin mold portion 14 is molded, by insertion of the engagement pin 38 of the bobbin 30 into the engagement hole 42 of the sealing member 58, the substrate 56 and the sealing member 58 are placed in a position corresponding to the connector 52, and the power source terminals 54 and the signal terminal 22 are placed in a position corresponding to the coupler 50. Then, in the above positional relationship, the amplifying member 40 is molded integrally with the resin mold portion 14. At the same time, the amplifying member 40 is molded integrally with the resin mold portion 14 in a state with a portion of the signal transmitting unit 24 being inserted into the connecting hole 60 of the substrate 56. That is, the engagement hole 42 and the engagement pin 38 cooperatively function as an assembly unit for assembling the substrate 56 and the sealing member 58 to the second signal transmitting member 72.

By connecting a non-illustrated connector to the coupler 50, electrical power is supplied to the amplifying member 40 and the sensor 20 through the power source terminals 54, the detection value (detection signal) detected by the sensor 20 is output externally as an electric signal through the signal terminal 22, and the coil 28 of the housing 12 is electrically energized with electric current from the drive terminals 44.

The fuel supply unit 16, for example, includes a supply passage (not shown) through which fuel is supplied, in the interior of the fixed core 26, and a non-illustrated fuel pipe is connected to an end of the supply passage that opens on the proximal end side (in the direction of the arrow A) of the fuel injection valve 10. In addition, the fuel supplied through the fuel pipe passes through the supply passage, and is supplied to the side of the fuel injector 18 disposed on the distal end side (in the direction of the arrow B).

As shown in FIG. 1, the fuel injector 18 comprises a valve housing 64 that is connected to a distal end of the housing 12, and a valve element (not shown) that is incorporated in the distal end of the valve housing 64. In addition, fuel is supplied from the fuel supply unit 16 into the interior of the valve housing 64, and by the valve element being moved toward the proximal end side (in the direction of the arrow A) upon excitation of the solenoid unit, fuel is injected from the distal end into the combustion chamber at a predetermined pressure.

The valve housing 64, for example, is formed from a metallic material. The valve housing 64 includes a flange 66 that closes the distal end of the solenoid unit, and a tubular portion 68 that extends along a straight line to the distal end side (in the direction of the arrow B) from the flange 66. The cylindrical sensor 20 is press-inserted and fitted on an outer circumferential side on the distal end of the tubular portion 68.

The sensor 20, for example, is equipped with a piezoelectric element (not shown) in the interior thereof, and connection terminals, which are connected to the piezoelectric element, are exposed on the proximal end side (in the direction of the arrow A). Further, a retaining portion 80 of a later-described cover member 78 abuts against an outer circumferential surface of the sensor 20, and a distal end inner circumferential side of the sensor 20, for example, is coupled by being welded around the entire circumference with respect to the valve housing 64.

The signal transmitting unit 24 includes a first signal transmitting member 70 disposed on the outer circumferential side of the valve housing 64 and connected to the sensor 20, and a second signal transmitting member 72 accommodated in the holder 32 of the housing 12, and which connects the first signal transmitting member 70 and the signal terminal 22.

As shown in FIG. 1, the first signal transmitting member 70, for example, includes an insulating body 74 formed in a cylindrical shape from a resin material, and which is disposed on the outer circumferential side of the tubular portion 68 in the valve housing 64, and a first conductive layer 76 disposed in the interior of the insulating body 74. In addition, the first conductive layer 76 is electrically connected, for example by solder or the like, to a connection terminal (not shown) of the sensor 20.

The insulating body 74 is formed from a resin material such as a heat resistant resin or the like, and is formed such that the proximal end side thereof (in the direction of the arrow A) is expanded in diameter corresponding to the shape of the valve housing 64 so as to cover the tubular portion 68 and the flange 66. The first conductive layer 76, which is made up from a plating layer, for example, is formed in the center in the thickness along a diametrical direction of the insulating body 74, and the first conductive layer 76 is formed in a cylindrical shape along the insulating body 74 at a substantially constant thickness. A distal end of the insulating body 74 is press inserted into the interior of the sensor 20 and around the tubular portion 68 of the valve housing 64.

On the other hand, on an outer circumferential side of the insulating body 74, a cover member 78, which is formed, for example, in a cylindrical shape from a metallic material, is mounted so as to cover the insulating body 74. The cover member 78 is formed such that the proximal end side thereof (in the direction of the arrow A) is expanded in diameter corresponding to the shape of the valve housing 64 so as to cover the tubular portion 68 and the flange 66. The retaining portion 80 that retains the outer circumferential surface of the proximal end side of the sensor 20 is formed on the distal end of the cover member 78.

The second signal transmitting member 72 is formed, for example, from a resin material, and is constituted in a plate shape having a predetermined length along the axial direction (the direction of arrows A and B), and a second conductive layer 82 (see FIG. 2), which is formed from an electrically conductive material, is formed in the interior of the second signal transmitting member 72. The second conductive layer 82 is formed, for example, from a plating layer, which extends at a substantially constant thickness from the distal end to the proximal end along the axial direction (the direction of arrows A and B) of the second signal transmitting member 72.

A first connector 84, which projects in a perpendicular direction to the axial direction, is formed at the distal end of the second signal transmitting member 72. The first connector 84 is formed so as to face the proximal end of the first signal transmitting member 70. In addition, the first connector 84 is inserted into a recess or cavity of the first signal transmitting member 70. The first conductive layer 76 of the first signal transmitting member 70 and the second conductive layer 82 that is exposed in the recess, are connected electrically by solder or the like.

On the other hand, a shaft-shaped second connector 86, which is reduced in diameter with respect to the distal end side, is included on the proximal end of the second signal transmitting member 72. A portion of the second conductive layer 82 is exposed in an annular shape on the second connector 86 along the outer circumferential surface thereof. In addition, as shown in FIGS. 2 and 4B, by the second connector 86 being inserted into the connecting hole 60 formed in the substrate 56 through the through hole 62 of the amplifying member 40, and being electrically connected to the substrate 56 by solder or the like, the second signal transmitting member 72 is connected electrically with the amplifying member 40.

Consequently, a condition is brought about in which the sensor 20 and the signal terminal 22 are connected to each other electrically through the first and second signal transmitting members 70, 72.

The fuel injection valve 10 equipped with a cylinder internal pressure sensor according to the embodiment of the present invention is constructed basically as described above. Next, a case will be described of assembling the amplifying member 40 with respect to the bobbin 30 and the resin mold portion 14.

First, as shown in FIG. 4A, in a condition in which the proximal end of the bobbin 30 is arranged upwardly (in the direction of the arrow A), for example, a non-illustrated operator grips the substrate 56 and the sealing member 58 of the amplifying member 40 in a substantially parallel manner, and brings them into proximity to the side of the bobbin 30 (in the direction of the arrow B). Then, simultaneously with insertion of the engagement pin 38 into the engagement hole 42, the second connector 86 of the second signal transmitting member 72 is inserted through the through hole 62 and into the connecting hole 60. More specifically, the engagement pin 38 and the second connector 86 are inserted from below with respect to the amplifying member 40.

Accordingly, the amplifying member 40 is retained under an engagement action of the lower surface thereof with the engagement pin 38 and the second signal transmitting member 72, and is maintained in a horizontal state substantially perpendicular to the axial direction (the direction of arrows A and B) of the fuel injection valve 10.

Further, the second connector 86 of the second signal transmitting member 72, by being inserted into the connecting hole 60, is placed in contact with a conductive layer (not shown) of the substrate 56, and is connected electrically by solder or the like in such a state of contact.

Next, after the proximal end side of the signal transmitting unit 24 and the housing 12 including the bobbin 30 have been arranged in a forming mold for molding the resin mold portion 14, by filling an interior cavity thereof with a molten resin material, the main body section 48 that constitutes the resin mold portion 14 is formed so as to surround the circumference of the fixed core 26, and the connector 52 and the coupler 50 are formed so as to cover the amplifying member 40.

At this time, since the amplifying member 40 is retained in a state of being positioned on the proximal end side of the bobbin 30 and the signal transmitting unit 24, the amplifying member 40 is molded at a predetermined position in the resin mold portion 14.

As a result, the amplifying member 40 is molded integrally in the interior of the resin mold portion 14, such that portions of the power source terminals 54 and the signal terminal 22 that make up the amplifying member 40 are exposed from the coupler 50, and the integrally connected resin mold portion 14 is formed by insertion of the resin material into the first grooves 34 of the fixed core 26 and the second groove 46 of the holder 32.

Next, operations of the fuel injection valve 10, which has been assembled in the foregoing manner, will be described.

In a non-illustrated internal combustion engine during driving, by a control signal from the electronic control unit, the coil 28 is energized from the drive terminals 44 of the fuel injection valve 10, so that the coil 28 is excited. Then, under displacement action of the movable core, the valve element of the fuel injector 18 is opened, and high pressure fuel, which is supplied by the supply passage of the fuel supply unit 16, is injected directly into the combustion chamber of the internal combustion engine through the fuel injector 18. At this time, by a pressure (cylinder internal pressure) in the combustion chamber being applied, the piezoelectric element of the sensor 20 generates a voltage corresponding to the pressure, which is output as a detection signal.

The detection signal is output to the amplifying member 40 via the sensor 20, the first signal transmitting member 70, and the second signal transmitting member 72, and after the detection signal has been amplified in the amplifying member 40, the detection signal is output to the electronic control unit through the signal terminal 22.

In addition, for example, in the electronic control unit, the pressure of the combustion chamber is calculated from the amplified output signal, and based on the calculated pressure, a combustion control or the like can be performed.

As has been described above, according to the present embodiment, in the fuel injection valve 10 having the sensor 20 on the distal end thereof, the amplifying member 40, which amplifies and outputs the detection signal that is detected by the sensor 20, is provided in the interior of the resin mold portion 14. Further, on another end of the amplifying member 40, the connecting hole 60, in which the second connector 86 of the second signal transmitting member 72 is inserted, is formed in the substrate 55, and at a position on another end side from the connecting hole 60, the engagement hole 42 is formed in which the engagement pin 38 of the bobbin 30 is inserted.

Owing to such features, when the amplifying member 40 is molded in the interior of the resin mold portion 14, in a state in which the second signal transmitting member 72 has been inserted into and connected to the connecting hole 60, the engagement pin 38 is inserted into the engagement hole 42. Thus, in a state that the amplifying member 40 is suitably positioned at a position corresponding to the coupler 50 and the connector 52 of the resin mold portion 14 while the amplifying member 40 is retained substantially horizontally, molding of the resin mold portion 14 can be carried out.

As a result, positional shifting of the amplifying member 40 from the predetermined position when the resin mold portion 14 is molded can be prevented, and since the amplifying member 40 can be molded easily and reliably at the predetermined position, the connection between the amplifying member 40 and the signal transmitting unit 24 is maintained reliably, and problems such as a disconnection or the like are prevented.

Further, upon assembly of the amplifying member 40, the engagement hole 42 is engaged with the engagement pin 38 of the bobbin 30 in a state with the second connector 86 of the second signal transmitting member 72 being connected to the substrate 56, whereby the amplifying member 40 can be assembled at a predetermined position reliably and easily, and ease of assembly can be enhanced.

Furthermore, since the power source terminals 54 and the signal terminal 22 provided on the amplifying member 40 can be positioned reliably at a predetermined position of the coupler 50, connection of the connector, which is connected to the coupler 50, can reliably be performed without the occurrence of shifting of the power source terminals 54 and the signal terminal 22.

The fuel injection valve equipped with a cylinder internal pressure sensor according to the present embodiment is not limited to the embodiment described above, and various additional or modified configurations may be adopted therein without departing from the scope of the present invention as set forth in the appended claims.

What is claimed is:

1. A fuel injection valve equipped with a cylinder internal pressure sensor, the fuel injection valve being configured to directly inject fuel into a combustion chamber of an internal combustion engine, the sensor being provided at an end of the fuel injection valve, the sensor being configured to detect a cylinder internal pressure in an interior of the combustion chamber, the fuel injection valve comprising:

a housing;

a signal transmitting member disposed in an interior of the housing and configured to transmit a detection signal based on the cylinder internal pressure; and a drive unit configured to drive a valve element by energizing a coil assembly including a coil;

wherein the signal transmitting member includes an amplifying unit configured to amplify and output the detection signal, the amplifying unit being constituted as a circuit body in which a substrate is molded by a resin material, power source terminals being connected to the substrate, the power source terminals being configured to supply electrical power to the sensor; and the fuel injection valve further comprises an assembly unit configured to assemble the circuit body and the coil assembly, wherein the amplifying unit and the coil assembly are covered with a resin mold portion.

2. The fuel injection valve equipped with the cylinder internal pressure sensor according to claim 1, wherein the assembly unit comprises:

a recess disposed on one of the circuit body and the coil assembly; and a projection disposed on another one of the circuit body and the coil assembly other than the one on which the recess is disposed.

3. The fuel injection valve equipped with the cylinder internal pressure sensor according to claim 2, wherein the recess is formed in a sealing member, the sealing member being configured to cover the substrate in the circuit body, and the projection is disposed on a bobbin of the coil assembly.

* * * * *